United States Patent [19]

Stevenson

[11] 4,337,963

[45] Jul. 6, 1982

[54] SKATEBOARD STRUCTURE

[76] Inventor: Richard L. Stevenson, 738 Loma Vista, El Segundo, Calif. 90245

[21] Appl. No.: 65,946

[22] Filed: Aug. 13, 1979

[51] Int. Cl.[3] ..... A63C 17/02; A63C 5/12

[52] U.S. Cl. ..... 280/87.04 A; 280/610

[58] Field of Search ..... 280/29, 87.01, 87.04 R, 280/87.04 A, 1.208, 610, 11.19, 11.28, 603, 608; 428/44, 52, 72, 73, 116, 117; 52/787, 793, 802, 803, 806, 807; 9/310 E, 6 P; 272/144, 97, 33 R; 264/278, 274, 263, 250

[56] References Cited

U.S. PATENT DOCUMENTS 821,806 5/1906 Johnston ..... 9/310 E
2,413,530 12/1946 Taylor ..... 280/87.04 A
3,403,919 10/1968 Weibling ..... 280/7.13
3,635,484 1/1972 Nakamura et al. ..... 280/610
3,992,025 11/1976 Amelio ..... 280/87.04 A

*Primary Examiner*—Joseph F. Peters, Jr.
*Assistant Examiner*—Randall A. Schrecengost
*Attorney, Agent, or Firm*—Keith D. Beecher

[57] ABSTRACT

A skateboard structure is provided which is formed of a top piece and a bottom piece, the pieces being formed of appropriate injection molded plastic material, such as polypropylene, polyethylene, polycarbonate, "Plexiglass", or other plastic material which is susceptible to injection molding; or aluminum casting or compression molded fiberglass; or any other material which may be molded or cast. The inner surface of each piece is formed with a lattice-work of integral webs, so that when the pieces are fitted together they define a reinforcing honeycomb-like core.

6 Claims, 6 Drawing Figures

SKATEBOARD STRUCTURE

RELATED PATENT APPLICATIONS

Ser. No. 883,726—filed Mar. 6, 1978—now abandoned.

BACKGROUND

Skateboards have developed from an original, relatively simple construction comprising a simple board with rollerskate trucks mounted at each end thereof, to plastic and wood constructions of a variety of shapes and sizes. Plastic skateboards are preferred from a cost and durability standpoint. However, to make large skateboards out of plastic which are functional requires massive size, excessive weight, and disproportionate high cost. Skateboards with solid foam cores and wrapped with fiberglass are presently available, but they too are extremely expensive.

An objective of the present invention is to provide a low cost, good looking, light and sturdy skateboard which may be formed by injection molding. This is achieved by providing a two-piece injection molded plastic structure with a honeycomb core. By such a construction, the desired strength is achieved without the need for the board to be unduly expensive, massive, heavy or thick, and yet it still maintains maximum rigidity and strength. This construction also permits color combinations heretofore impossible in lowcost prior art one-piece skateboards. The construction of the invention also permits the pieces to be post formed during the cooling cycle of injection molding to induce curvatures favorable for marketing purposes.

The invention provides, therefore, a skateboard structure which permits the use of inexpensive injection molded plastic, without the need to resort to massive and impractical skateboard weights, and impractical skateboard sizes to achieve the desired strength. As pointed out above, the skateboard of the invention can also be formed of fiberglass, or aluminum, or other materials capable of being cast or molded.

DETAILED DESCRIPTION OF THE ILLUSTRATED EMBODIMENT

Figure 1:
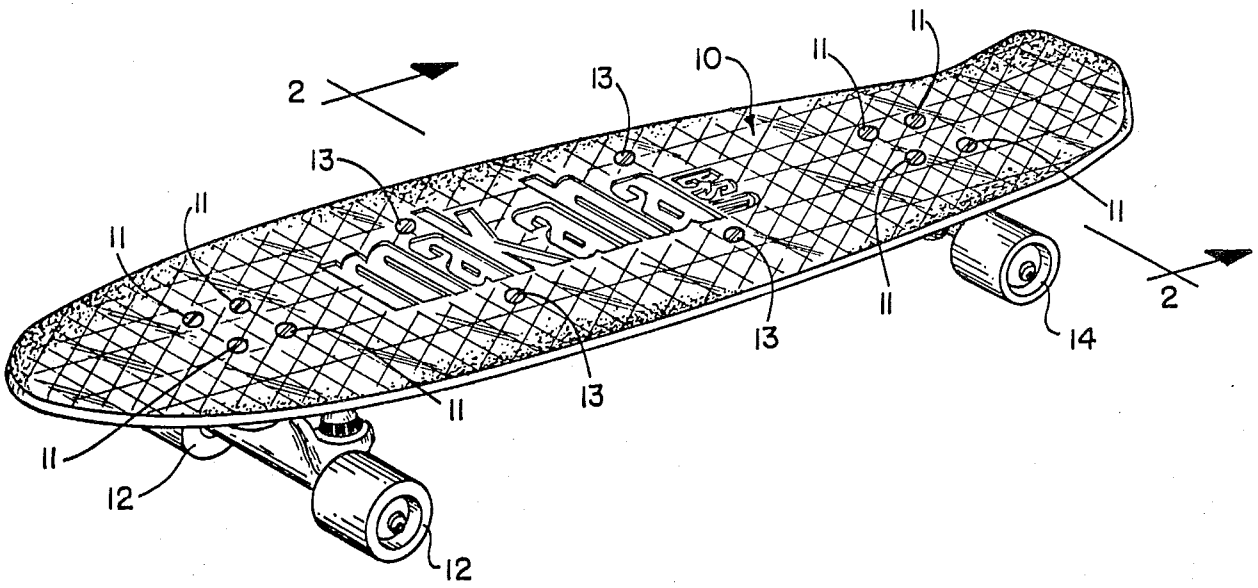
FIG. 1 is a perspective view of a skateboard constructed in accordance with the concepts of the present invention, and which includes a two-piece plastic platform with a honey-comb core.

As shown in FIG. 1, the skateboard of the invention includes a platform 10, with rollerskate trucks 12 and 14 mounted at each end. The trucks are attached to the platform by screws 11.

Figure 2:
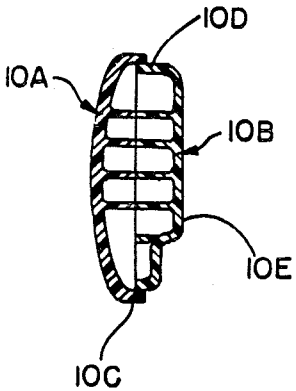
FIG. 2 is a section of the skateboard platform, taken essentially along the line 3—3 of FIG. 1.

The platform 10, as shown in FIG. 2 includes a top piece 10A and a bottom piece 10B. As stated above, the pieces may be formed of injection molded plastic material such as polypropylene, polyethylene, polycarbonate, "Plexiglass" or other suitable plastic material which is susceptible to injection molding. The two pieces are held together by screws 13 (FIG. 1) which assure that there will be no creaking between the pieces when the skateboard is in use.

Figure 3:
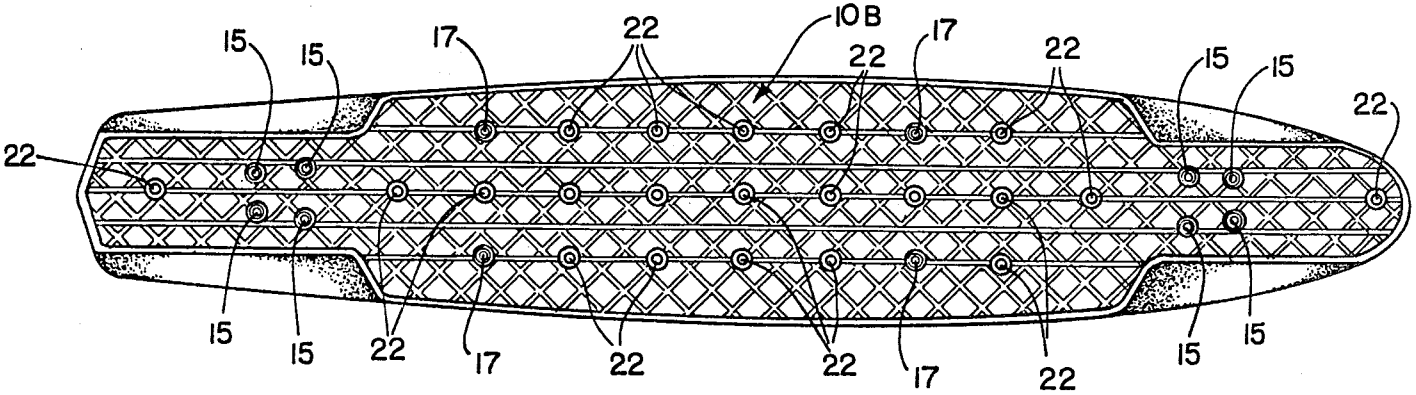
FIG. 3 is a plan view of the bottom piece of the platform, looking down from the top thereof.

As shown in FIG. 3, the bottom piece 10B has a lattice-work formed integral with its inner surface of the illustrated configuration. Integral bushings 15 are formed in the lattice-work to receive the screws 11 of FIG. 1. Further integral bushings 17 are provided in the lattice-work to receive the screws 13. Yet further integral bushings 22 are formed in the lattice-work. All the bushings are flush with the upper surface of the lattice-work.

As shown in FIG. 2, the top piece 10A has a rim 10C which extends down over the rim 10D of the bottom piece. The overlapping upper rim 10C assures that there will be no gap between the peripheral edges of the two pieces, and provides added strength at the perimeter of the skateboard and high resistance to impacts.

Figure 4:
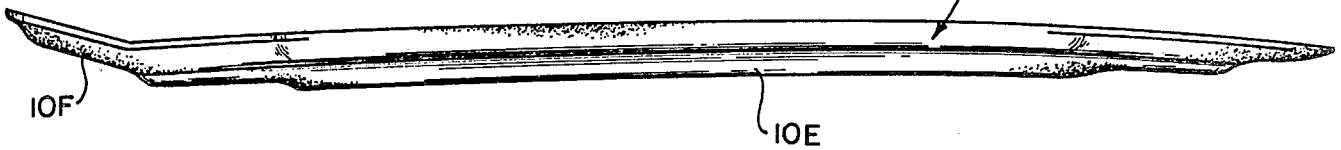
FIG. 4 is a side elevational view of the bottom piece of FIG. 4.

As shown in FIGS. 2 and 4, the bottom piece is shaped to form a beam 10E extending from the front end to the base of the kick-tail 10F. This beam creats added strength to the platform.

Figure 5:
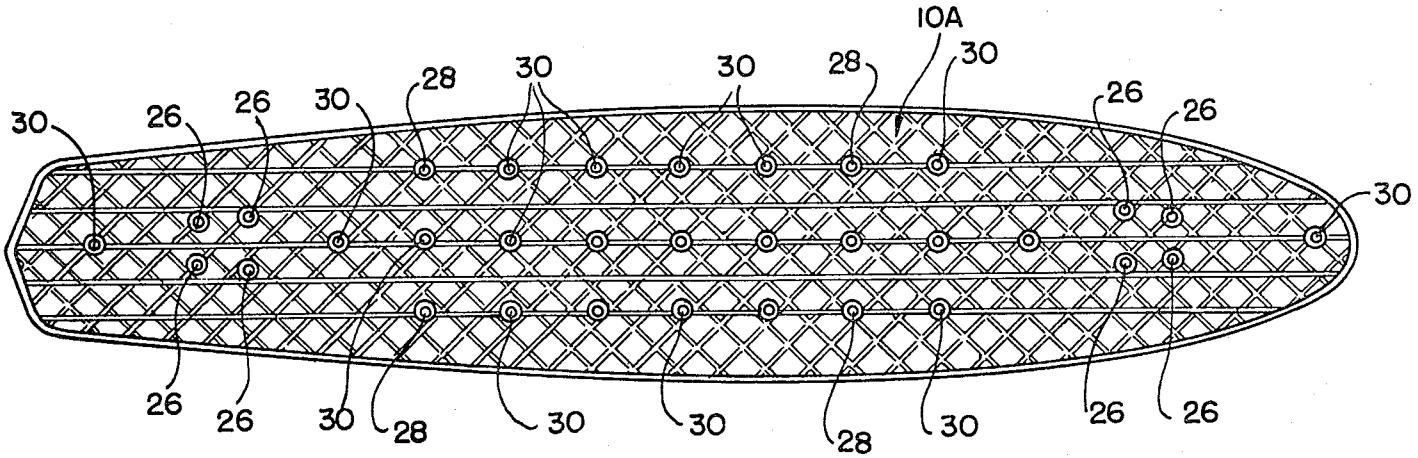
FIG. 5 is a bottom plan view of the top piece of the platform of FIG. 1.
Figure 6:
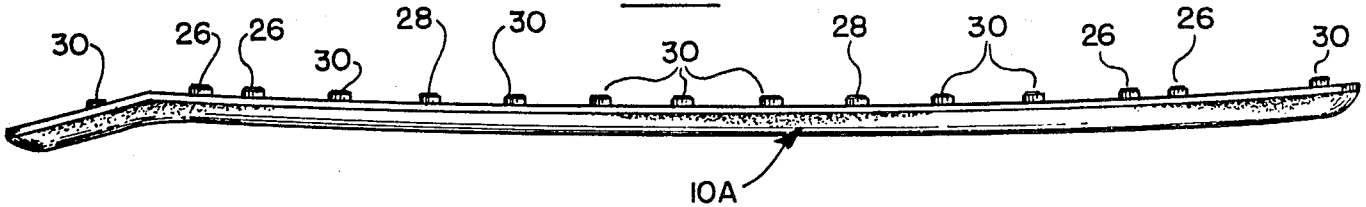
FIG. 6 is a side elevational view of the top piece of FIG. 5.

As shown in FIG. 5, the top piece 10A is also formed with an inner surface defining an integral lattice-work which is identical to the lattice-work of bottom piece 10B. Then, when the two pieces are fitted together, as shown in FIG. 2, they define a reinforcing honeycomb core for the skateboard. A plurality of hollow integral nipples 26 are formed in the lattice-work to be received in bushings 15 of FIG. 2. A further plurality of hollow integral nipples 28 are formed in the lattice-work to be received in bushings 17 of FIG. 3; and a plurality of integral nipples 30 are formed in the lattice-work to be received in bushings 22 of FIG. 3. All the nipples extend beyond the surface of the lattice-work, as shown in FIG. 6.

This construction, as noted above, permits a skateboard to be constructed with the desired strength of readily available injection molded plastic, or other, materials. The resulting skateboard is relatively light, small in size, and may be sold for a relatively low price. The nipples and bushings intercouple with one another to provide a high shear strength to the assembly. These elements, together with beam 10E, provide a rigidity to the assembly which exceeds the solid oak boards of the prior art.

It will be appreciated that although a particular embodiment of the invention has been shown and described, modifications may be made. It is intended in the claims to cover all the modifications which come within the spirit and scope of the invention.

What is claimed is:

1. In a skateboard which comprises a platform and wheels mounted at each end of the platform, said platform being formed of a top piece and a bottom piece, each of the two pieces having intersecting lattice-work formed integral with the inner surface thereof, said pieces being fitted to one another to cause the lattice work of each piece to be contiguous to one another and to form a reinforcing honeycomb-like cellular core therebetween, a plurality of bushings formed integral with one of the pieces, and a plurality of nipples formed integral with the other of the pieces to be received in the bushings when the pieces are fitted together, and a plurality of screws extending through one of the pieces and through the nipples to be received in corresponding ones of said bushings to hold the two pieces together.

2. The skateboard defined in claim 1, in which each of said pieces and the lattice-work integral therewith is formed of an injection molded plastic material.

3. The skateboard defined in claim 1, in which the top piece has a rim which extends over and encompasses the rim of the bottom piece when the two pieces are fitted together.

4. The skateboard defined in claim 1, in which said bottom piece defines a longitudinal beam at the bottom thereof.

5. In a skateboard which comprises a platform and wheels mounted at each end of the platform, said platform being formed of a top piece and a bottom piece, each of the two pieces having intersecting lattice-work formed integral with the inner surface thereof, said pieces being fitted to one another to cause the lattice-work of each piece to be contiguous to one another and to form a reinforcing honeycomb-like cellular core therebetween, and a plurality of screws extending through one of the pieces to be received by the other of the pieces to hold the two pieces together.

6. The skateboard defined in claim 5, in which said bottom piece defines a longitudinal beam at the bottom thereof.

* * * * *